US009124055B2

(12) United States Patent
Ott et al.

(10) Patent No.: US 9,124,055 B2
(45) Date of Patent: Sep. 1, 2015

(54) OSCILLATION PROOF BRUSHBLOCK FOR SLIPRINGS

(71) Applicant: Schleifring und Apparatebau GmbH, Fürstenfeldbruck (DE)

(72) Inventors: Johannes Ott, Fürstenfeldbruck (DE); Thomas Bernhardt, Fürstenfeldbruck (DE); Christian Holzapfel, Fürstenfeldbruck (DE); Michael Sergl, München (DE)

(73) Assignee: SCHLEIFRING UND APPARATEBAU GMBH, Furstenfeldbruck (DE)

( * ) Notice: Subject to any disclaimer, the term of this patent is extended or adjusted under 35 U.S.C. 154(b) by 0 days.

(21) Appl. No.: 14/100,592

(22) Filed: Dec. 9, 2013

(65) Prior Publication Data

US 2014/0099800 A1 Apr. 10, 2014

Related U.S. Application Data

(63) Continuation of application No. PCT/EP2012/060917, filed on Jun. 8, 2012.

(51) Int. Cl.

| | |
|---|---|
| ***H01R 39/08*** | (2006.01) |
| ***H01R 39/39*** | (2006.01) |
| ***H01R 39/24*** | (2006.01) |

(52) U.S. Cl.

CPC ..... *H01R 39/39* (2013.01); *H01R 39/24* (2013.01)

(58) Field of Classification Search

CPC ..... H01R 39/38; H01R 39/00; H01R 39/24; H01R 39/26; H01R 39/08; H01R 39/34; H01R 39/64; H01R 39/381; H01R 39/20

USPC ..... 310/248, 232, 246, 245, 251; 439/26, 439/29, 25, 30

See application file for complete search history.

(56) References Cited

U.S. PATENT DOCUMENTS

| | | | |
|---|---|---|---|
| 4,398,113 | A | 8/1983 | Lewis et al. |
| 4,415,635 | A | 11/1983 | Wilsdorf et al. |

(Continued)

FOREIGN PATENT DOCUMENTS

| | | |
|---|---|---|
| DE | 66 01 184 | 3/1969 |
| DE | 102 15 809 | 11/2003 |

(Continued)

OTHER PUBLICATIONS

Search Report and Written Opinion in PCT/EP2012/060917 mailed Mar. 11, 2013.

(Continued)

*Primary Examiner* — Gary Paumen

(74) *Attorney, Agent, or Firm* — Norton Rose Fulbright US LLP

(57) ABSTRACT

A slip ring assembly for the electrical connection of two rotating parts has at least a sliding track with V-grooves. At least two brushes of electrically conductive material are contacting the sliding track within the V-groove. The brushes are connected electrically with each other and mounted at different levels resulting in a different distance to the rotation axis of the sliding track. This results in an improved resistance against shock and vibrations.

16 Claims, 2 Drawing Sheets

(56) References Cited

U.S. PATENT DOCUMENTS

| | | | | |
|---|---|---|---|---|
| 8,167,623 | B2 * | 5/2012 | Schlichtherle et al. | 439/26 |
| 2014/0084523 | A1 * | 3/2014 | Herbst et al. | 266/103 |
| 2014/0111040 | A1 * | 4/2014 | Badafem et al. | 310/51 |

FOREIGN PATENT DOCUMENTS

| | | | |
|---|---|---|---|
| DE | 10 2008 001 361 | A1 | 11/2009 |
| EP | 0662736 | A | 7/2005 |
| JP | 2005228522 | | 8/2005 |

OTHER PUBLICATIONS

International Preliminary Report on Patentability in PCT/EP2012/060917 mailed Dec. 10, 2013.

* cited by examiner

OSCILLATION PROOF BRUSHBLOCK FOR SLIPRINGS

PRIORITY CLAIM

This application is a continuation of pending International Application No. PCT/EP2012/060917 filed on Jun. 8, 2012, which designates the United States and claims priority from German Application No. 10 2011 077 358 filed on 10 Jun. 2011, both of which are incorporated by reference in their entireties.

BACKGROUND OF THE INVENTION

1. Field of the Invention

The invention relates to a brush block and a slip-ring assembly for transferring electrical signals by sliding contacts between parts rotatable against each other. On a sliding track of electrically conductive material, at least one sliding contact also referred to as a brush, also of an electrically conductive material, slides. The galvanic contact between the sliding tracks and the brush enables the transfer of electrical power.

2. Description of Relevant Art

DE 10 2008 001 361 A1 discloses a slip-ring assembly where a brush with at least two sliding wires runs in a sliding track with a V-groove. The sliding wires have different diameters and contact the sliding track at different angular positions. This leads to increased tolerance against mechanical vibrations and impact and reduced contact resistance.

EP 0662736 A discloses a slip-ring assembly, where a single brush has several wires that run in a V-groove. This leads to a lower contact resistance due to connecting several contacts in parallel.

U.S. Pat. No. 4,398,113 A discloses another slip-ring assembly with brushes having a plurality of finest wires. Again, the multiple contacts lead to a relatively low contact resistance.

None of these slip ring assemblies allows for a reliable electrical contact at high shock and impact loads. During short time, strong external impact or vibrations, short-term contact interruptions occur from lifting of the brushes from the sliding track. In addition, interruptions may occur due to friction-induced internal oscillations that occur at different rotational speeds.

SUMMARY OF THE INVENTION

The embodiments are based on the object of designing a brush block and a slip ring assembly so that they will ensure reliable electrical contact even at strong, short impacts or vibrations. At the same time, this slip-ring assembly is to be producible cost-efficiently and have a high service life and reliability.

In an embodiment, a brush block for a sliding track comprises at least a first brush (also: wire brush) and a second brush of electrically conductive material that are fastened in a holder and electrically connected to each other. The two brushes are fastened in the holder on different levels and thus at different distances from the rotating axis of the sliding track. This leads to different lengths of the brushes between the holder and the respective contact points at the sliding track. Therefore, the mechanical properties of the two brushes are different. This leads to lower sensitivity against shocks and vibrations.

Preferably, the holder comprises a first carrier plate and a second carrier plate attached at a distance from the first carrier plate. The first brush is mechanically attached at least to the second carrier plate. It can also be mechanically attached to and/or in electrical contact with the first carrier plate. The second brush is only mechanically attached to the first carrier plate and is also electrically connected to it.

It is further preferred, if at least the first carrier plate is designed as a printed circuit board. This enables easy contacting of the brushes. A mechanical connection of the first carrier plate and the second carrier plate improves the entire stiffness of the brush block. Preferably, the mechanical connection of the first carrier plate and the second carrier plate is designed dampened so that the two printed circuit boards are mechanically isolated.

Preferably, the second printed circuit board also comprises a window through which the second brush can pass from the first printed circuit board without touching the second printed circuit board.

In another preferred embodiment, the holder is of a single piece, like a plastic injection-molded part.

The brushes are preferably metal wires and comprise at least one electrically conductive material. They preferably have a core of a mechanically stable and spring-elastic material, such as steel or brass, and an outer coating or sleeve of an electrically well conductive and preferably corrosion-resilient material, such as gold or a gold alloy.

It is particularly preferred when there are wire brushes with different wire geometries on the brush blocks, specifically with different wire diameters.

An embodiment of a slip-ring assembly according to the invention has a sliding track and at least one of the brush blocks disclosed in here. To guide the brushes, the sliding track preferably has at least one V-groove. Generally, sliding tracks with other geometries may be used as well. For example, this may be planar sliding tracks or sliding tracks with U-shaped grooves (semi-circular, ellipsoid).

Preferably, the slip-ring assembly comprises a plurality of the brush blocks, with preferably all brushes running on the same track being electrically connected in parallel.

It is further preferred, if at least two brush blocks are arranged on opposite sides of the rotation axis.

It is further preferred, if at least one brush block has a vibration-attenuating support. Preferably, the brush blocks have independent and/or different vibration-attenuating supports. Most preferably, they have different attenuation properties and/or different resonance frequencies.

Preferably, at least two brush blocks have different shapes. This also leads to different vibration properties of these brush blocks.

Preferably, a plurality of electrically connected brush bocks is placed around the sliding track at equidistant positions. For example, 3 brush blocks may be placed at an offset of 120 degrees each, or 4 brush blocks with an offset of 90 degrees each. This may increase the shock and vibration resistance further.

Alternatively, several electrically connected brush blocks may be placed at different distances around the sliding track. For example, 3 brush blocks may be placed offset by 90, 120 and 150 degrees. This may further increase the shock and vibration resistance.

In another preferred embodiment, at least one wire brush has at least a partial coating to improve its vibration properties. This coating may comprise an elastic material. It is preferably placed outside of the area that is in contact with the sliding track. Most preferably, different wire brushes on different brush blocks have different kinds of coatings. It is further preferred, if, a first sliding wire on a first brush block has a coating, while a second sliding wire on a second brush block has no coating.

In another embodiment, the ends of the sliding wires essentially protrude over the contact point with the sliding track. The protruding length is in a range between 0.2-2 times of the length between the brush block and the contact point with the sliding track. Most preferably, the protruding end is bent away from the slip ring and/or the sliding track.

BRIEF DESCRIPTION OF THE DRAWINGS

In the following, the invention will be described by way of example, without limitation of the general inventive concept, on examples of embodiment and with reference to the drawings.

Figure 1:
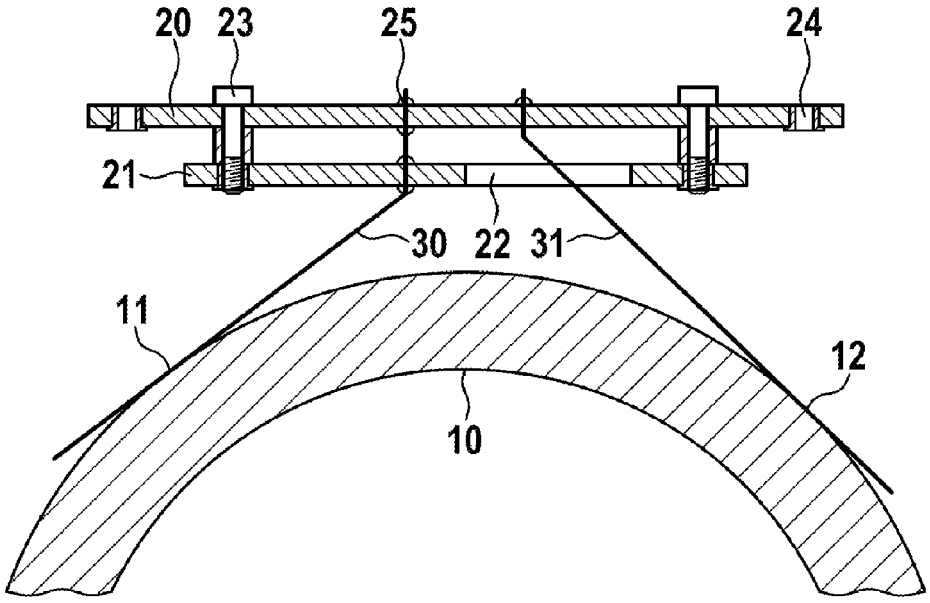
FIG. 1 shows a brush block and a sliding track according to the invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

FIG. 1 shows a first embodiment of a brush block. The brush block has a holder comprising a first printed circuit board 20 and a second printed circuit board 21. The two printed circuit boards are connected to each other via connection screws 23 (here with additional spacer roll or as a spacer bolt) so that they are on different levels or at different distances to the rotating axis of the sliding track 10. A first brush 30 and a second brush 31 are attached to the holder. The first brush 30 is connected to the first printed circuit board 20 for electrical connection by means of solder points 25. It is furthermore mechanically connected to the second printed circuit board 21, preferably by means of another soldering point 25. The mechanical connection may be any other kind of mechanical connection as well. The mechanical fastening to the second printed circuit board is essential here. The second brush 31 is also connected electrically and mechanically to the first printed circuit board 20 by means of a soldering point 25. Both brushes are electrically connected by the first printed circuit board 20. Thus, the distance of the mechanical fastening of the two brushes from the center of the sliding track is different. The first brush 30 contacts the sliding track 10 in the contact point 11, while the second brush 31 contacts the sliding track 10 at the contact point 12. The second printed circuit board 21 has a window 22 through which the second brush 31 may penetrate without mechanically contacting second printed circuit board 21.

Figure 2:
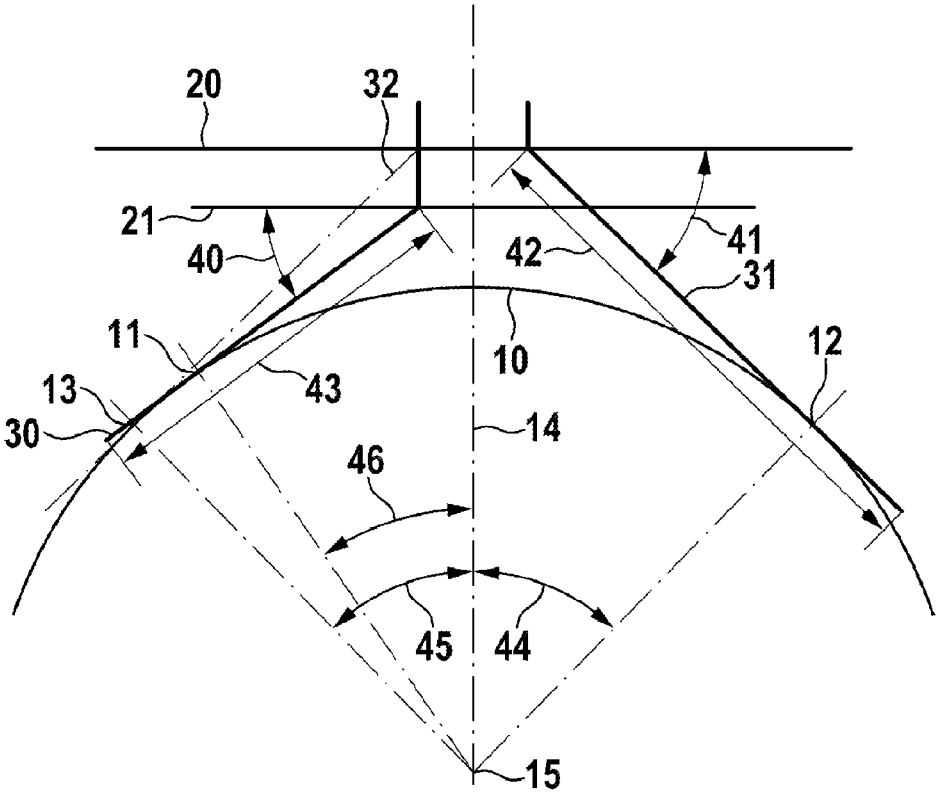
FIG. 2 shows a schematic of the geometry of an embodiment.

FIG. 2 shows the geometry of an embodiment as a schematic. For better visibility, the lower edges of the printed circuit boards 20 and 21 and the outer edge of the sliding track 10 are only indicated schematically as a line. The center axis 14 goes from the rotating axis of the sliding track 15 under a right angle to the brush block, here illustrated as going vertically upwards. The brush 31 has an angle 41 relative to the lower edge of the first printed circuit board 20 and a length 42. It contacts the sliding track 10 in the contact point 12 under an angle of 44 to the center axis. The angle is preferably in the range of 20° to 60°, but may extend to 90°. The necessary length of a brush results from the distance between the attachment point of the brush at the printed circuit board and the contact point of the brush with the sliding track plus some additional length by which the brush protrudes over the contact point. The brush 30 has an angle 40 against the lower edge of the second printed circuit board 21 and a length 43. The angle 40 is less than the angle 41. Preferably, it is in a range of 80% to 95% of the angle 41. Accordingly, the length 43 of the first brush is also shorter than the length 42 of the second brush. The first brush contacts the sliding track in contact point 11 here under an angle 46 to the center axis 10. A consistent protrusion is assumed here. This embodiment results in different mechanical properties of the brushes, like resonant frequencies.

The dashed line shows the position of a brush 32 in a setup as known from prior art. Here, the first brush would be attached to the first printed circuit board like the second brush so that the first brush would contact the sliding track at a contact point 13 under an angle 45 to the center axis. This angle would be the same as the angle 44 and wider than the angle 46. Here, both brushes would have the same mechanical properties like resonant frequencies.

It will be appreciated to those skilled in the art having the benefit of this disclosure that this invention is believed to provide sliprings and sliding contacts for transferring electrical signals. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 sliding track
11 first contact point
12 second contact point
13 contact point from prior art
14 center axis
15 rotating axis of the sliding track
20 first printed circuit board
21 second printed circuit board
22 opening in the second printed circuit board
23 connection screw
24 attachment bore
25 soldering point
30 first brush
31 second brush
32 brush from prior art
40 angle between the first brush and second printed circuit board
41 angle between the second brush and first printed circuit board
42 length of the second brush

43 length of the first brush
44 angle between contact point 12 and center axis
45 angle between contact point 13 and center axis
46 angle between contact point 11 and center axis 10

The invention claimed is:

1. A brush block for a sliding track, the brush block comprising:

a holder comprising a first carrier plate and a second carrier plate that is parallel to the first carrier plate;

a first brush comprising an electrically conductive material; and a second brush comprising an electrically conductive material and electrically connected to the first brush, where the first brush is attached to the holder at a different distance from a rotating axis of the sliding track than the second brush, the second brush is attached to the first carrier plate, and the first brush is attached to the second carrier plate, and the second brush is electrically connected to the first carrier plate, and the first brush is electrically connected to the first carrier plate and the second carrier plate.

2. A brush block according to claim 1, wherein the holder and/or the carrier plates comprise electrical printed circuit boards.

3. A brush block according to claim 1, wherein at least one brush comprises a core of a mechanically stable and spring-elastic material and an outer coating or sleeve of electrically conductive material.

4. A brush block according to claim 3, where the core comprises steel or brass.

5. A brush block according to claim 3, where the material of the outer coating or sleeve is corrosion resistant.

6. A brush block according to claim 5, where the material of the outer coating or sleeve comprises gold or gold alloy.

7. A brush block according to claim 1, wherein the first brush and the second brush comprise wires with different wire diameters.

8. A brush block for a sliding track, the brush block comprising:

a first brush comprising an electrically conductive material; and a second brush comprising an electrically conductive material and electrically connected to the first brush;

wherein the first brush and second brush are both attached to a holder, with the first brush attached to the holder at a smaller distance from a rotating axis of the sliding track than the second brush, the first brush is shorter than the second brush, and the first brush is configured to rest at the sliding track at a smaller angle to a center axis than an angle between the second brush and the center axis, the center axis passing through the brush block and the rotating axis at a right angle to the rotating axis.

9. A slip-ring assembly comprising a sliding track and at least one brush block according to claim 1.

10. A slip-ring assembly comprising a sliding track and at least one brush block according to claim 2.

11. A brush block according to claim 8, wherein at least one of the carrier plates comprises an electrical printed circuit board.

12. A brush block according to claim 8, wherein at least one of the first brush and second brush comprises a core of a mechanically stable and spring-elastic material, and an outer coating or sleeve of electrically conductive material.

13. A brush block according to claim 12, where the core comprises steel or brass.

14. A brush block according to claim 12, where the material of the outer coating or sleeve is corrosion resistant.

15. A brush block according to claim 14, where the material of the outer coating or sleeve comprises gold or gold alloy.

16. A brush block according to claim 8, wherein the first brush and the second brush comprise wires with different wire diameters.

* * * * *